US010276338B2

(12) United States Patent
Bruan et al.

(10) Patent No.: US 10,276,338 B2
(45) Date of Patent: Apr. 30, 2019

(54) HOLLOW FUSE BODY WITH TRENCH

(71) Applicant: LITTELFUSE, INC., Chicago, IL (US)

(72) Inventors: Ped Peterson Bruan, Batangas (PH); Grace Miranda, Lipa (PH); Conrado De Leon, Manila (PH)

(73) Assignee: LITTELFUSE, INC., Chicago, IL (US)

( * ) Notice: Subject to any disclaimer, the term of this patent is extended or adjusted under 35 U.S.C. 154(b) by 0 days.

(21) Appl. No.: 15/700,566

(22) Filed: Sep. 11, 2017

(65) Prior Publication Data

US 2017/0372862 A1 Dec. 28, 2017

Related U.S. Application Data

(63) Continuation of application No. 15/169,887, filed on Jun. 1, 2016.

(51) Int. Cl.

| | |
|---|---|
| ***H01H 85/143*** | (2006.01) |
| ***H01H 85/157*** | (2006.01) |
| ***H01H 85/175*** | (2006.01) |
| *H01H 85/045* | (2006.01) |

(52) U.S. Cl.

CPC ..... *H01H 85/143* (2013.01); *H01H 85/157* (2013.01); *H01H 85/175* (2013.01); *H01H 85/0458* (2013.01)

(58) Field of Classification Search

CPC ..... H01H 85/143; H01H 85/175
USPC ..... 337/232
See application file for complete search history.

(56) References Cited

U.S. PATENT DOCUMENTS

| | | | | |
|---|---|---|---|---|
| 1,494,141 | A | 5/1924 | Snow | |
| 1,861,369 | A | 5/1932 | Sundt | |
| 2,222,291 | A | 11/1940 | Freeman | |
| 3,094,600 | A | 6/1963 | Kozacka | |
| 3,333,336 | A | 8/1967 | Cameron | |
| 3,460,086 | A | 8/1969 | Aloysius | |
| 3,644,861 | A * | 2/1972 | Fister | H01H 85/153 337/252 |
| 3,721,936 | A | 3/1973 | Belcher | |
| 3,962,668 | A | 6/1976 | Knapp, Jr. | |
| 3,979,709 | A | 9/1976 | Healey, Jr. | |
| 4,101,860 | A * | 7/1978 | Fister | H01H 85/10 337/159 |

(Continued)

FOREIGN PATENT DOCUMENTS

| | | | |
|---|---|---|---|
| JP | 03233825 | A | 10/1991 |
| JP | 08106845 | A | 4/1996 |

*Primary Examiner* — Anatoly Vortman

(57) ABSTRACT

Provided herein are protection devices, such as fuses, including a set of trenches or pockets for retention of solder therein. In some embodiments, a fuse includes a body including a center portion extending between a first and second end portions. The first end portion includes a first trench formed in a first end surface, and the second end portion includes a second trench formed in a second end surface. The fuse may further include a first and second endcaps surrounding respective first and second end portions. The fuse may include a fusible element disposed within a central cavity of the body, the fusible element extending between the first end surface and the second end surface. In some embodiments, solder may be disposed within the first trench and the second trench, wherein the solder is in contact with the fusible element, the first endcap, or the second endcap.

19 Claims, 8 Drawing Sheets

(56) References Cited

U.S. PATENT DOCUMENTS

| | | | | |
|---|---|---|---|---|
| 4,122,426 | A | 10/1978 | Maruo | |
| 4,158,187 | A | 6/1979 | Perreault | |
| 4,159,458 | A * | 6/1979 | Wiebe | H01H 85/157 337/232 |
| 4,205,294 | A | 5/1980 | Jacobs, Jr. | |
| 4,346,362 | A | 8/1982 | Feenan et al. | |
| 4,460,887 | A | 7/1984 | McAlear et al. | |
| 4,467,308 | A | 8/1984 | Arikawa et al. | |
| 4,540,969 | A | 9/1985 | Sugar | |
| 4,646,053 | A | 2/1987 | Mosesian | |
| 4,656,453 | A | 4/1987 | Reeder | |
| 4,684,915 | A | 8/1987 | Knapp, Jr. | |
| 4,703,299 | A | 10/1987 | Vermij | |
| 4,746,784 | A | 5/1988 | Vermij | |
| 4,893,107 | A | 1/1990 | Moner | |
| 4,918,420 | A | 4/1990 | Sexton | |
| 4,920,327 | A | 4/1990 | Arikawa et al. | |
| 5,111,177 | A | 5/1992 | Krueger et al. | |
| 5,214,406 | A | 5/1993 | Reese et al. | |
| 5,235,307 | A | 8/1993 | Oh | |
| 5,642,090 | A * | 6/1997 | Arikawa | H01H 85/0418 337/186 |
| 5,926,084 | A | 7/1999 | Frochte | |
| 5,994,994 | A | 11/1999 | Ito et al. | |
| 6,778,061 | B2 | 8/2004 | Nakano et al. | |
| 6,798,330 | B2 | 9/2004 | Arikawa et al. | |
| 7,138,899 | B2 | 11/2006 | Jollenbeck et al. | |
| 7,250,843 | B2 | 7/2007 | Richter et al. | |
| 7,320,171 | B2 | 1/2008 | Jollenbeck et al. | |
| 8,203,420 | B2 * | 6/2012 | Wiryana | H01H 85/175 337/232 |
| 8,368,502 | B2 | 2/2013 | Washizaki et al. | |
| 8,937,524 | B2 | 1/2015 | de Leon et al. | |
| 9,202,656 | B2 | 12/2015 | Salonga et al. | |
| 9,224,564 | B2 | 12/2015 | Enriquez et al. | |
| 9,558,905 | B2 | 1/2017 | Arce et al. | |
| 9,953,791 | B1 * | 4/2018 | Bruan | H01H 85/0013 |
| 2009/0072943 | A1 * | 3/2009 | Aberin | H01H 69/02 337/186 |

* cited by examiner

HOLLOW FUSE BODY WITH TRENCH

CROSS-REFERENCE TO RELATED APPLICATION

This application is a continuation-in-part of co-pending U.S. patent application Ser. No. 15/169,887 filed Jun. 1, 2016, entitled "HOLLOW FUSE BODY WITH NOTCHED ENDS," and incorporated by reference herein in its entirety.

BACKGROUND

Field

The present disclosure relates generally to fuses. More specifically, the present disclosure relates to fuses that include a hollow fuse body.

Description of Related Art

Fuses are used as circuit protection devices and form an electrical connection with the component in a circuit to be protected. A particular fuse design includes a hollow fuse body, a fusible element disposed within the hollow body, and an endcap connected to each end of the fusible element. Furthermore, a first of the two endcaps is coupled to a first end of the hollow body and a second of the two endcaps is coupled to a second end of the hollow body.

Due to the tight tolerance between the hollow body and the endcaps, very little solder flows around the fusible element. More specifically, during assembly of the fuse, there may not be sufficient area to allow the solder to reflow and achieve a consistent and reliable solder connection to the fusible element. Moreover, inspection of hollow body fuses with endcaps occasionally reveals fuses that have inferior solder bonds at, or in the vicinity of, the fusible element. It is with respect to these and other considerations that the present disclosure is provided.

SUMMARY

Hollow protection devices, such as hollow body fuses, are disclosed. Furthermore, methods to provide hollow bodies and hollow body fuses are disclosed. In one implementation, a hollow body includes a center portion and an end portion. An endcap may be coupled to the end portion. A cavity is formed between an inside surface of the endcap and an outer periphery of the end portion. A fusible element may be disposed within the hollow body, and may further be disposed within the cavity formed between the inside surface of the endcap and the outer periphery of the end portion, the fusible element extending along a substantially diagonal path through a center of the cavity. Solder may fill the cavity and surround the fusible element to create a resilient and durable solder connection to the fusible element.

In some approaches, according to the disclosure, a fuse includes a hollow body having a center portion extending between a first end portion and a second end portion, wherein the first end portion includes a first trench disposed in a first end surface, and wherein the second end portion includes a second trench disposed in a second end surface. The fuse may further include a first endcap surrounding the first end portion and a second endcap surrounding the second end portion. The fuse may further include a fusible element disposed within a central cavity of the hollow body, the fusible element extending between the first end surface and the second end surface. The fuse may further include solder disposed within the first trench and the second trench, the solder in contact with at least one of: the fusible element, the first endcap, and the second endcap.

In some approaches, according to the disclosure, a protection device includes a hollow body having a center portion extending between a first end portion and a second end portion, wherein the first end portion includes a plurality of first trenches formed in a first end surface, and wherein the second end portion includes a plurality of second trenches formed in a second end surface. The protection device may further include a first endcap surrounding the first end portion and a second endcap surrounding the second end portion, and a fusible element disposed within a central cavity of the hollow body, the fusible element extending between the first end surface and the second end surface. The protection device may further include solder disposed within one or more of the first plurality of trenches and one or more of the second plurality of trenches, the solder in contact with the first endcap and the second endcap.

In some approaches, according to the disclosure, a protection device may include a fuse body having a center portion extending between a first end portion and a second end portion, wherein the first end portion includes a plurality of first trenches recessed into a first end surface, and wherein the second end portion includes a plurality of second trenches recessed into a second end surface. The protection device may further include a first endcap surrounding the first end portion and a second endcap surrounding the second end portion, and a fusible element disposed within a central cavity of the fuse body, the fusible element extending between and wrapping around the first end surface and the second end surface. The protection device may further include solder disposed within one or more of the first plurality of trenches and one or more of the second plurality of trenches, the solder in contact with the first endcap, the second endcap, and the fusible element.

BRIEF DESCRIPTION OF THE DRAWINGS

The accompanying drawings illustrate exemplary approaches of the disclosed embodiments so far devised for the practical application of the principles thereof, and in which.

Figure 1:
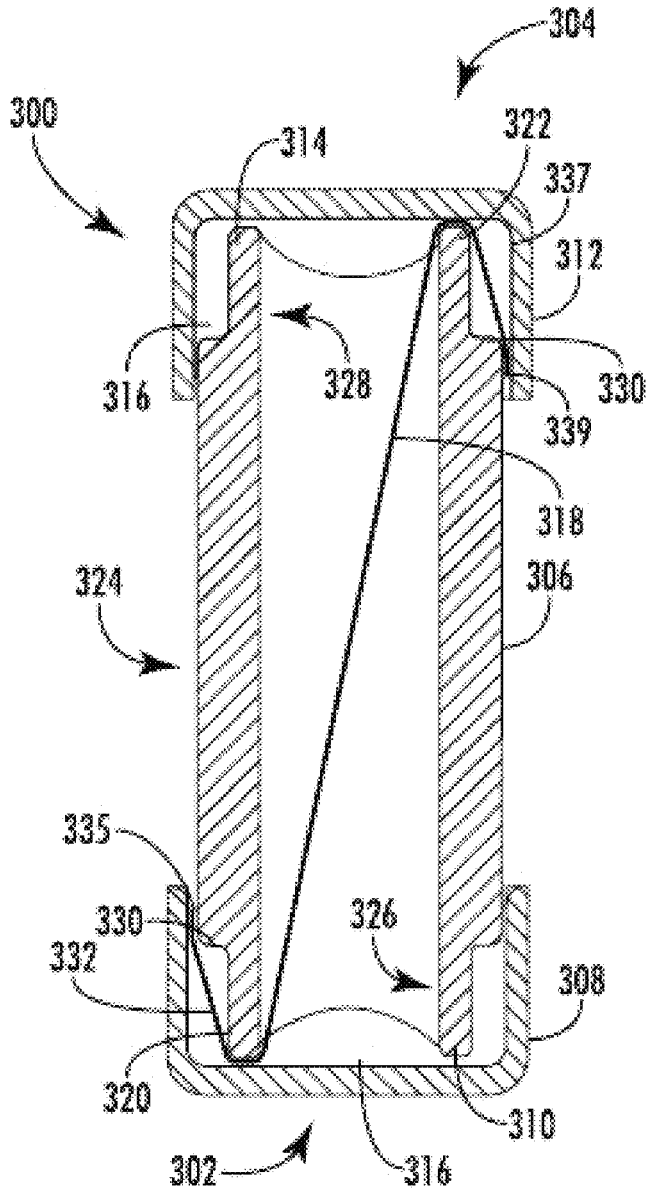
FIG. 1 illustrates a fuse according to embodiments of the disclosure.

The drawings are not necessarily to scale. The drawings are merely representations, not intended to portray specific parameters of the disclosure. The drawings are intended to depict typical embodiments of the disclosure, and therefore should not be considered as limiting in scope. In the drawings, like numbering represents like elements.

Furthermore, certain elements in some of the figures may be omitted, or illustrated not-to-scale, for illustrative clarity. Furthermore, for clarity, some reference numbers may be omitted in certain drawings.

DETAILED DESCRIPTION

Embodiments in accordance with the present disclosure will now be described more fully hereinafter with reference to the accompanying drawings. The system/circuit may be embodied in many different forms and should not be construed as being limited to the embodiments set forth herein. Rather, these embodiments are provided so that this disclosure will be thorough and complete, and will fully convey the scope of the system and method to those skilled in the art.

For the sake of convenience and clarity, terms such as "top," "bottom," "upper," "lower," "vertical," "horizontal," "lateral," and "longitudinal" will be used herein to describe the relative placement and orientation of various components and their constituent parts. Said terminology will include the words specifically mentioned, derivatives thereof, and words of similar import.

As used herein, an element or operation recited in the singular and proceeded with the word "a" or "an" should be understood as not excluding plural elements or operations, unless such exclusion is explicitly recited. Furthermore, references to "one embodiment" of the present disclosure are not intended to be interpreted as excluding the existence of additional embodiments that also incorporate the recited features.

As will be discussed in greater detail herein, the disclosure provides protection devices, such as fuses, including a set of trenches or pockets for retention of solder therein. In some embodiments, a fuse includes a body including a center portion extending between a first and second end portions. The first end portion includes a first trench formed in a first end surface, and the second end portion includes a second trench formed in a second end surface. The fuse may further include a first and second endcaps surrounding respective first and second end portions. The fuse may include a fusible element disposed within a central cavity of the body, the fusible element extending between the first end surface and the second end surface. In some embodiments, solder may be disposed within the first trench and the second trench, wherein the solder is in contact with the fusible element, the first endcap, or the second endcap.

Embodiments of the present disclosure demonstrate an alternative and an improvement to a slotting/dicing housing approach. A first technical advantage includes providing multiple trenches in the fuse body to increase the surface area of the ceramic material, which helps to obtain better cap retention between the cap and body once solder flows in these areas. A second technical advantage includes the use of the trenches as an entry point for air pressure from a cooling chamber in order to obtain better solder dome formation for fuses using a drop-in process. More specifically, the design of the present fuse body allows pressure to penetrate on each of the multiple (e.g., 4) sides, which allows better solder dome formation than conventional slotted bodies having slots on two sides only.

FIG. 1 illustrates a side cross-sectional view of a fuse 300 in accordance with a non-limiting embodiment of the present disclosure. The fuse 300 may have a generally circular profile in cross-section, as viewed end-on from a bottom 302 or top 304 of the fuse 300. Alternatively, the fuse 300 may have a generally rectangular profile in cross-section, as viewed end-on from the bottom 302 or the top 304 of the fuse 300. The fuse 300 may be implemented as other shape profiles as well. The fuse 300 may have a hollow body 306. The hollow body 306 may be ceramic, plastic, or other suitable electrically non-conducting material. A first endcap 308 may fit over a first end 310 of the hollow body 306 and a second endcap 312 may fit over a second end 314 of the hollow body 306.

Solder 316 may be disposed within each of the endcaps 308 and 312. Furthermore, as will be described in further detail below, the solder 316 may be disposed along a periphery of the hollow body 306. The fuse 300 further includes a fusible element 318, such as wire. The fusible element 318 may be disposed within the hollow body 306. Furthermore, the fusible element 318 may extend along a bottom portion 320 of the first end 310. The fusible element 318 may also extend along a top portion 322 of the second end 314.

The hollow body 306 includes a central portion 324. The central portion 324 has an outer cross-sectional profile of a first size. The hollow body 306 also includes a first end portion 326 that terminates at the first end 310. The first end portion 326 has an outer cross-sectional profile of a second size, where the second size is less than the first size. Therefore, the first end portion 326 is narrower than the central portion 324. In other words, depending on a shape of the hollow body 306, an area, perimeter, diameter, circumference, or the like associated with the first size is greater than an area, perimeter, diameter, circumference, or the like associated with the second size. The hollow body 306 also includes a second end portion 328 that terminates at the second end 314. The second end portion 328 has an outer cross-sectional profile of a second size, where the second size is less than the first size. Therefore, the second end portion 328 is narrower than the central portion 324. In other words, an area, perimeter, diameter, circumference, or the like associated with the first size is greater than the area, perimeter, diameter or circumference associated with the second size.

The central portion 324 of the hollow body 306 integrally couples to the first end portion 326 at a shoulder 330 that extends inwardly to join to the first end portion 326. Similarly, the central portion 324 of the hollow body 306 integrally couples to the second end portion 328 at a shoulder 331 that extends inwardly to join to the second end portion 328.

The fusible element 318 extends through a cavity 332 that is defined between an outer periphery of the first end portion 326 and an inside surface of the first endcap 308. The fusible element 318 extends along a substantially diagonal path through a center of the cavity 332 and terminates at an end 335 that is sandwiched between an inside surface of the first endcap 208 and an outer periphery of the central portion 324. The cavity 332 enables the solder 316 to completely surround at least a portion of the fusible element 318 disposed within the cavity 332.

Similarly, the fusible element 318 is disposed within a cavity 337 that is defined between an outer periphery of the second end portion 328 and an inside surface of the second endcap 312. The fusible element 318 extends along a substantially diagonal path through a center of the cavity 337 and terminates at an end 339 that is sandwiched between an inside surface of the second endcap 312 and an outer periphery of the central portion 324. The cavity 337 enables the solder 316 to completely surround at least a portion of the fusible element 318 disposed within the cavity 337.

In one embodiment, the fusible element 318 does not come into direct contact with an outer periphery of the first end portion 326. That is, the fusible element 318 is offset from the outer periphery of the first end portion 326. Furthermore, in one embodiment, the fusible element 318 does not come into direct contact with an outer periphery of the second end portion 328. That is, the fusible element 318 is offset from an outer periphery of the second end portion 328. Rather, the solder 316 is disposed between the fusible element 318 and an outer periphery of the first end portion 326, and the 316 is disposed between the fusible element 318 and an outer periphery of the second end portion 328.

Figure 2:
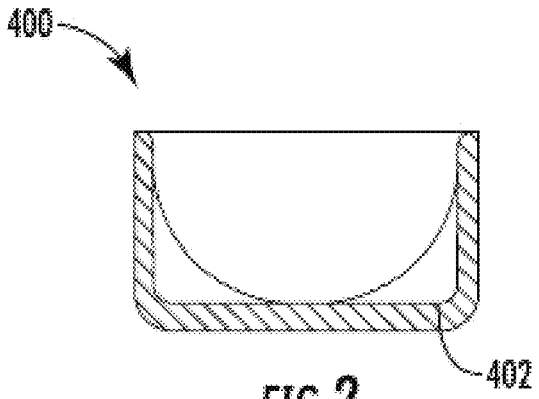
FIG. 2 illustrates an exemplary fuse endcap with solder disposed therein according to embodiments of the disclosure.

FIG. 2 illustrates and exemplary endcap 400 with solder 402 disposed therein. The endcap 400 may be substantially similar to the first and second endcaps 308 and 312 described above. In a process or method of manufacturing the fuse 300, the endcap 400 may be at least partially fitted over the first end 310 of the hollow body 306. Furthermore, another endcap 400 may be at least partially fitted over the second end 314 of the hollow body 306. The fusible element 318 may be arranged within the interior and further arranged on the exterior of the hollow body 306, as illustrated in FIG. 1, prior to the fitting of one or more of the endcaps 400. The process of fitting the endcaps 400 over the hollow body 306 may include heating the endcaps 400 to melt the solder 402. The process of melting the solder enables the solder to flow at least into the cavities 332.

Figure 3:
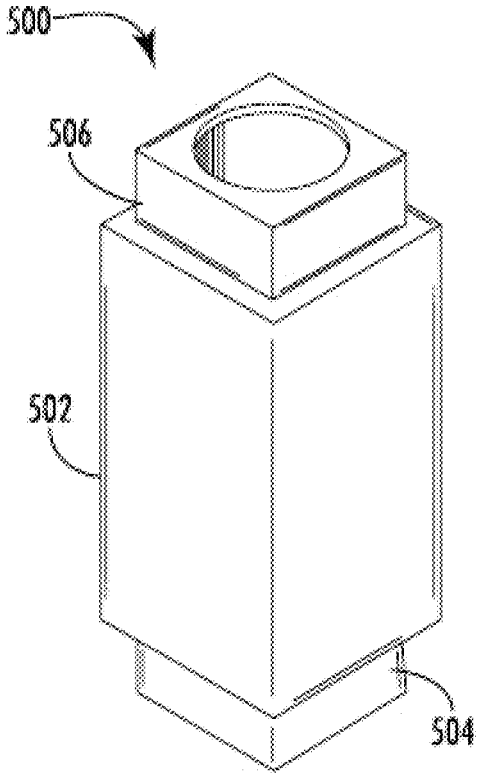
FIGS. 3-8 illustrate exemplary hollow body implementations according to the embodiments of the disclosure.

FIG. 3 illustrates an exemplary embodiment of a hollow body 500. The hollow body 500 may be implemented as part of a fuse, such as the fuse 300 described above. The hollow body 500 has an outer square cross-sectional profile. The hollow body 500 may include a central portion 502. The central portion 502 has an outer square cross-sectional profile. The central portion 502 has an outer cross-sectional profile of a first size. The hollow body 500 also includes a first end portion 504. The first end portion 504 has an outer cross-sectional profile of a second size, where the second size is less than the first size. In other words, an area or perimeter associated with the first size is greater than an area or perimeter associated with the second size. The hollow body 500 also includes a second end portion 506. The second end portion 506 has an outer cross-sectional profile of a second size, where the second size is less than the first size. In other words, an area or perimeter associated with the first size is greater than an area or perimeter associated with the second size.

Figure 4:
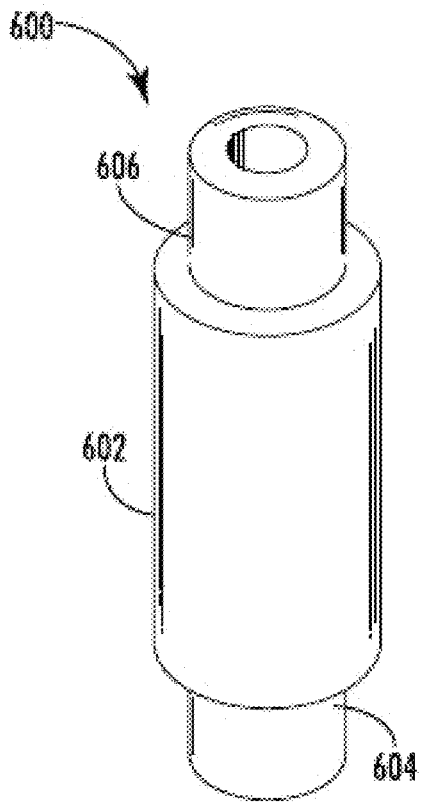

FIG. 4 illustrates an exemplary embodiment of a hollow body 600. The hollow body 600 may be implemented as part of a fuse, such as the fuse 300 described above. The hollow body 600 has an outer circular cross-sectional profile. The hollow body 600 may include a central portion 602. The central portion 602 has an outer circular cross-sectional profile. The central portion 602 has an outer cross-sectional profile of a first size. The hollow body 600 also includes a first end portion 604. The first end portion 604 has an outer cross-sectional profile of a second size, where the second size is less than the first size. In other words, a circumference or diameter associated with the first size is greater than a circumference or diameter associated with the second size. The hollow body 600 also includes a second end portion 606. The second end portion 606 has an outer cross-sectional profile of a second size, where the second size is less than the first size. In other words, a circumference or diameter associated with the first size is greater than a circumference or diameter associated with the second size.

Figure 5:
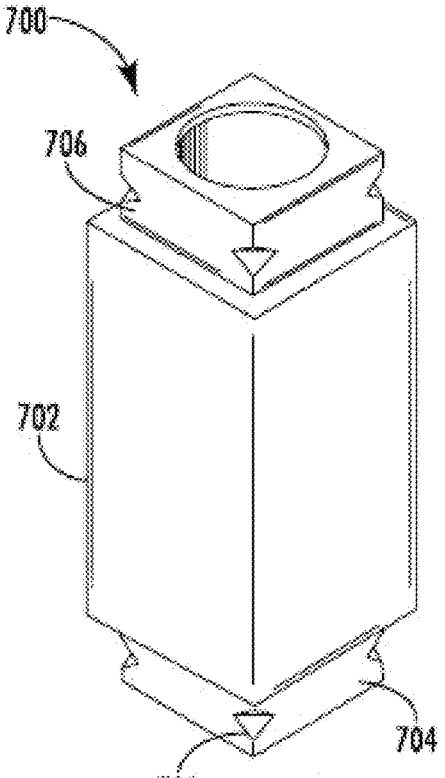

FIG. 5 illustrates an exemplary embodiment of a hollow body 700. The hollow body 700 may be implemented as part of a fuse, such as the fuse 300 described above. The hollow body 700 has an outer square cross-sectional profile. The hollow body 700 may include a central portion 702. The central portion 702 has an outer square cross-sectional profile. The central portion 702 has an outer cross-sectional profile of a first size. The hollow body 700 also includes a first end portion 704. The first end portion 704 has an outer cross-sectional profile of a second size, where the second size is less than the first size. In other words, an area or perimeter associated with the first size is greater than an area or perimeter associated with the second size. The hollow body 700 also includes a second end portion 706. The second end portion 706 has an outer cross-sectional profile of a second size, where the second size is less than the first size. In other words, an area or perimeter associated with the first size is greater than an area or perimeter associated with the second size.

The hollow body 700 illustrated in FIG. 5 may include one or more notches 708. The one or more notches 708 may be entirely or partially filled with solder when an endcap (e.g., endcap 400) is pressed onto an end portion (e.g., first end portion 704) of the hollow body 700. Heat may be applied to the endcap to enable the solder to flow. Thus, the one or more notches 708 may aid in the retention of an endcap pressed onto an end portion of the hollow body 700. More particularly, hardened solder in the one or more notches 708 may couple or be integral with hardened solder within the cavity 332. Therefore, the hardened solder in the one more notches 708 serves as an anchor for the endcap pressed onto an end portion of the hollow body 700.

Figure 6:
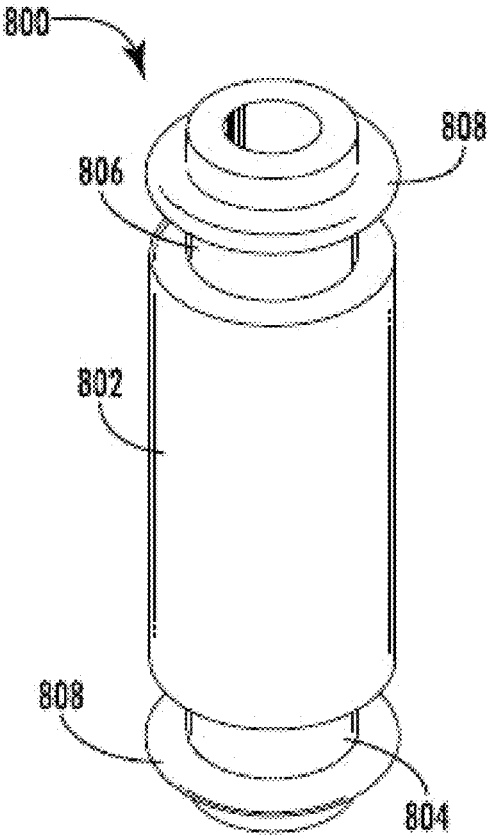

FIG. 6 illustrates an exemplary embodiment of a hollow body 800. The hollow body 800 may be implemented as part of a fuse, such as the fuse 300 described above. The hollow body 800 has an outer circular cross-sectional profile. The hollow body 800 may include a central portion 802. The central portion 802 has an outer circular cross-sectional profile. The central portion 802 has an outer cross-sectional profile of a first size. The hollow body 800 also includes a first end portion 804. The first end portion 804 has an outer cross-sectional profile of a second size, where the second size is less than the first size. In other words, a circumference or diameter associated with the first size is greater than a circumference or diameter associated with the second size. The hollow body 800 also includes a second end portion 806. The second end portion 806 has an outer cross-sectional profile of a second size, where the second size is less than the first size. In other words, a circumference or diameter associated with the first size is greater than a circumference or diameter associated with the second size.

The hollow body 800 illustrated in FIG. 6 may include one or more anchor ledges 808. The one or more anchor ledges 808 may be entirely or partially surrounded with solder when an endcap (e.g., endcap 400) is pressed onto an end portion (e.g., first end portion 804) of the hollow body 800. Heat may be applied to the endcap to enable the solder to flow around the one or more anchor ledges 808 and rigidly encapsulate the one or more anchor ledges 808 when the solder hardens. Thus, the one or more anchor ledges 808 may aid in the retention of an endcap pressed onto an end portion of the hollow body 800.

Figure 7:
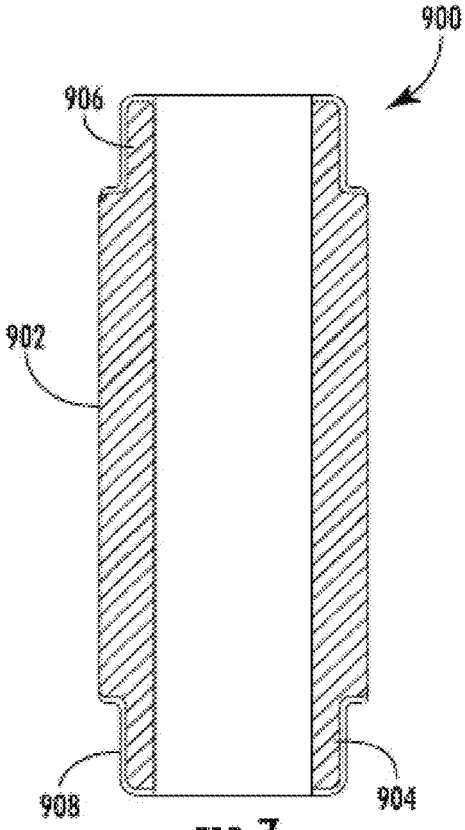

FIG. 7 illustrates an exemplary embodiment of a hollow body 900 in cross-section. The hollow body 900 may be implemented as part of a fuse, such as the fuse 300 described above. The hollow body 900 may include a central portion 902. The central portion 902 has an outer cross-sectional profile. The central portion 902 has an outer cross-sectional profile of a first size. The hollow body 900 also includes a first end portion 904. The first end portion 904 has an outer cross-sectional profile of a second size, where the second size is less than the first size. In other words, an area, circumference or diameter associated with the first size is greater than an area, circumference or diameter associated with the second size. The hollow body 900 also includes a second end portion 906. The second end portion 906 has an outer cross-sectional profile of a second size, where the second size is less than the first size. In other words, an area, circumference or diameter associated with the first size is greater than an area, circumference or diameter associated with the second size.

The hollow body 900 may include a layer of metallization 908 on each of the first end portion 904 and second end portion 906. Solder (not shown) may come in contact with the layer of metallization 908 when an endcap (e.g., endcap 400) is pressed onto an end portion (e.g., first end portion 904) of the hollow body 900. Thus, since the layer of metallization 908 is in contact with the solder and with portions of the fusible element 1010 (as shown in FIG. 8), the layer of metallization 908 may facilitate robust electrical conductivity between the solder, the fusible element 1010, and an endcap (e.g., endcap 400) that is pressed onto an end portion (e.g., first end portion 904) of the hollow body 900.

Figure 8:
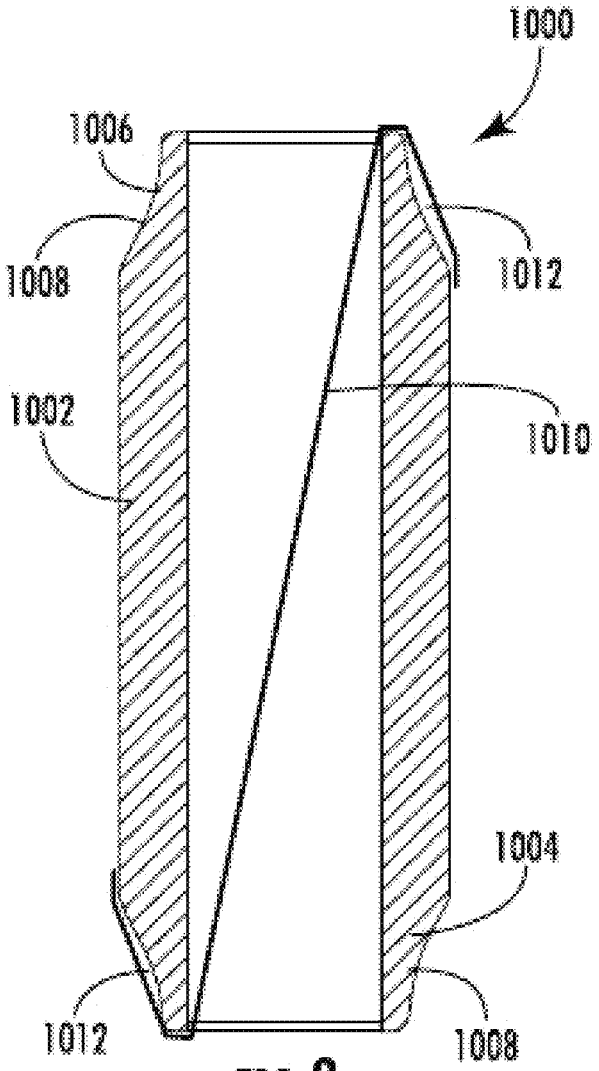

FIG. 8 illustrates an exemplary embodiment of a hollow body 1000. The hollow body 1000 may be implemented as part of a fuse, such as the fuse 300. The hollow body 1000 has an outer circular cross-sectional profile. The hollow body 1000 may include a central portion 1002. The central portion 1002 has an outer circular cross-sectional profile. The central portion 1002 has an outer cross-sectional profile of a first size. The hollow body 1000 also includes a first end portion 1004. The first end portion 1004 has an outer cross-sectional profile of a second size, where the second size is less than the first size. In other words, a circumference or diameter associated with the first size is greater than an area or diameter associated with the second size. The hollow body 1000 also includes a second end portion 1006. The second end portion 1006 has an outer cross-sectional profile of a second size, where the second size is less than the first size. In other words, a circumference or diameter associated with the first size is greater than an area or diameter associated with the second size.

Each of the first end portion 1004 and second end portion 1006 may have a generally concave or curved shape 1008. In one implementation, the generally concave or curved shape 1008 of each of the first end portion 1004 and the second end portion 1006 allows for the elimination of the shoulders 330 described above with regard to the fuse 300 (see FIG. 1). An exemplary fusible element 1010 is illustrated in FIG. 8 to show that a cavity 1012 is at least formed between each of the portions 1004 and 1006 and the fusible element 1010. Therefore, solder may and occupy the cavities 1012 and completely surround adjacent portions of the fusible element 1010 upon coupling endcaps to the hollow body 1000.

Figure 9:
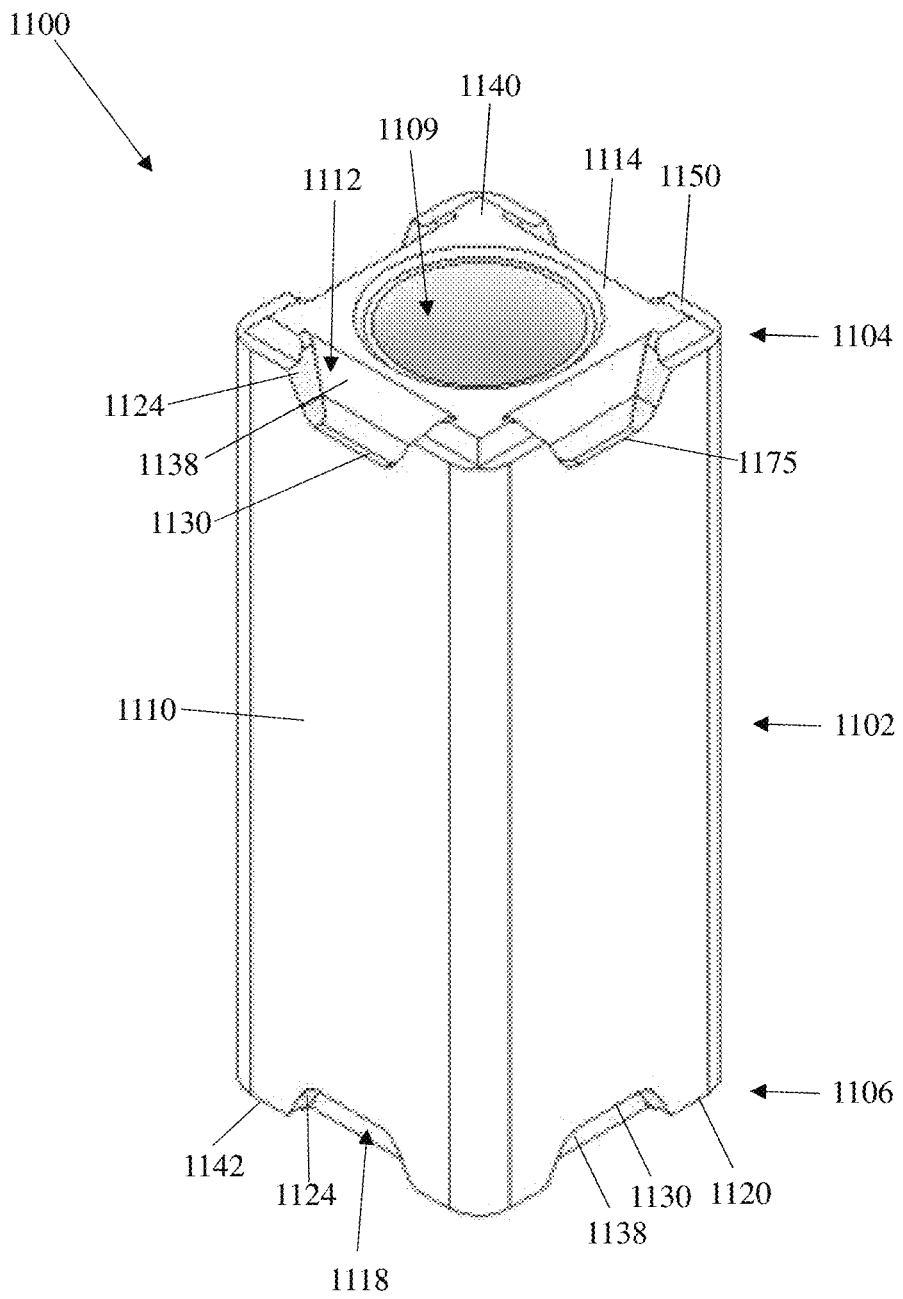
FIG. 9 illustrates a perspective view of a protection device having a body and trenches according to embodiments of the disclosure.
Figure 10A:
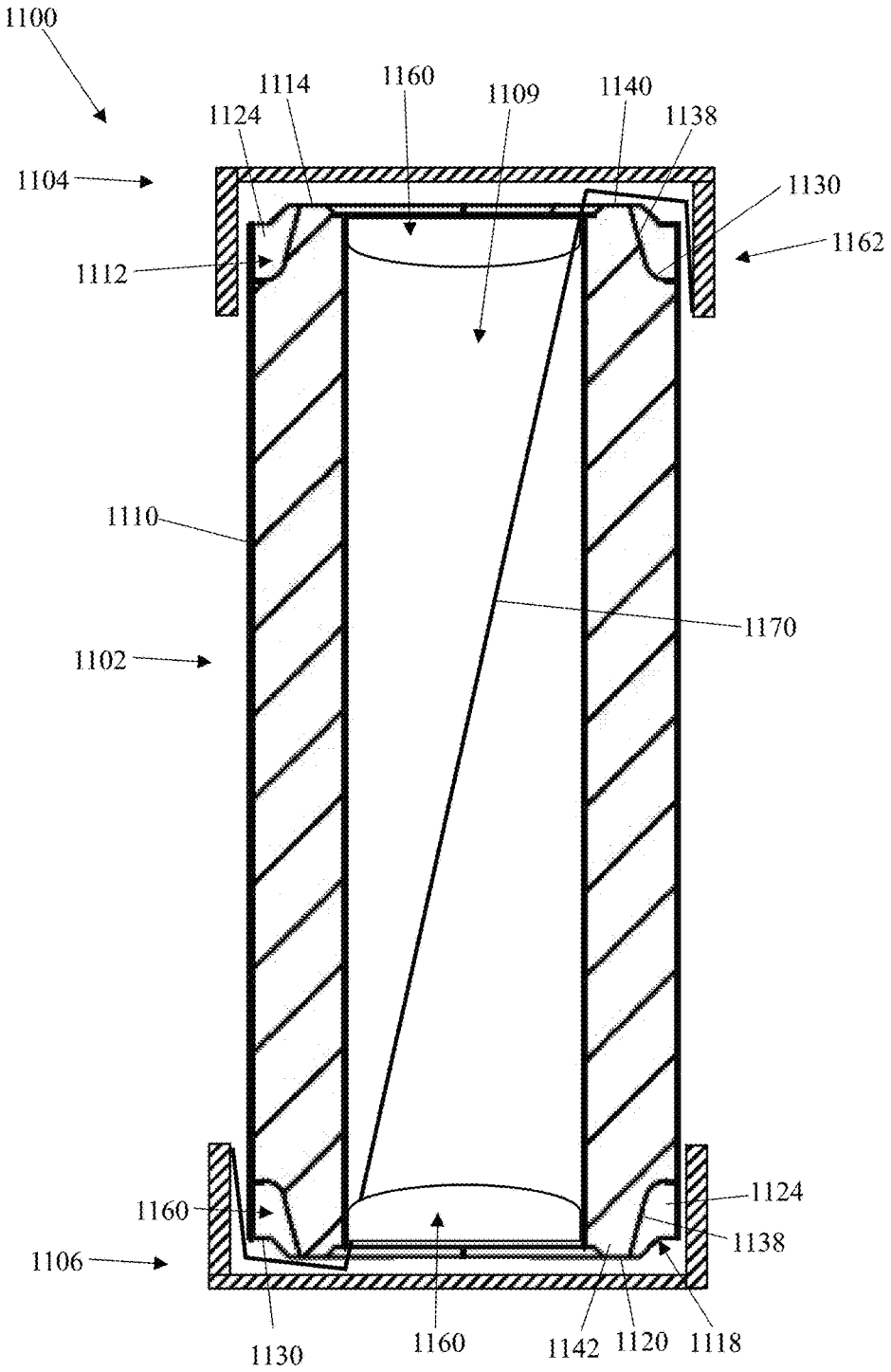
FIGS. 10A-B illustrates side cross-sectional views of protection devices according to exemplary embodiments of the disclosure.
Figure 10B:
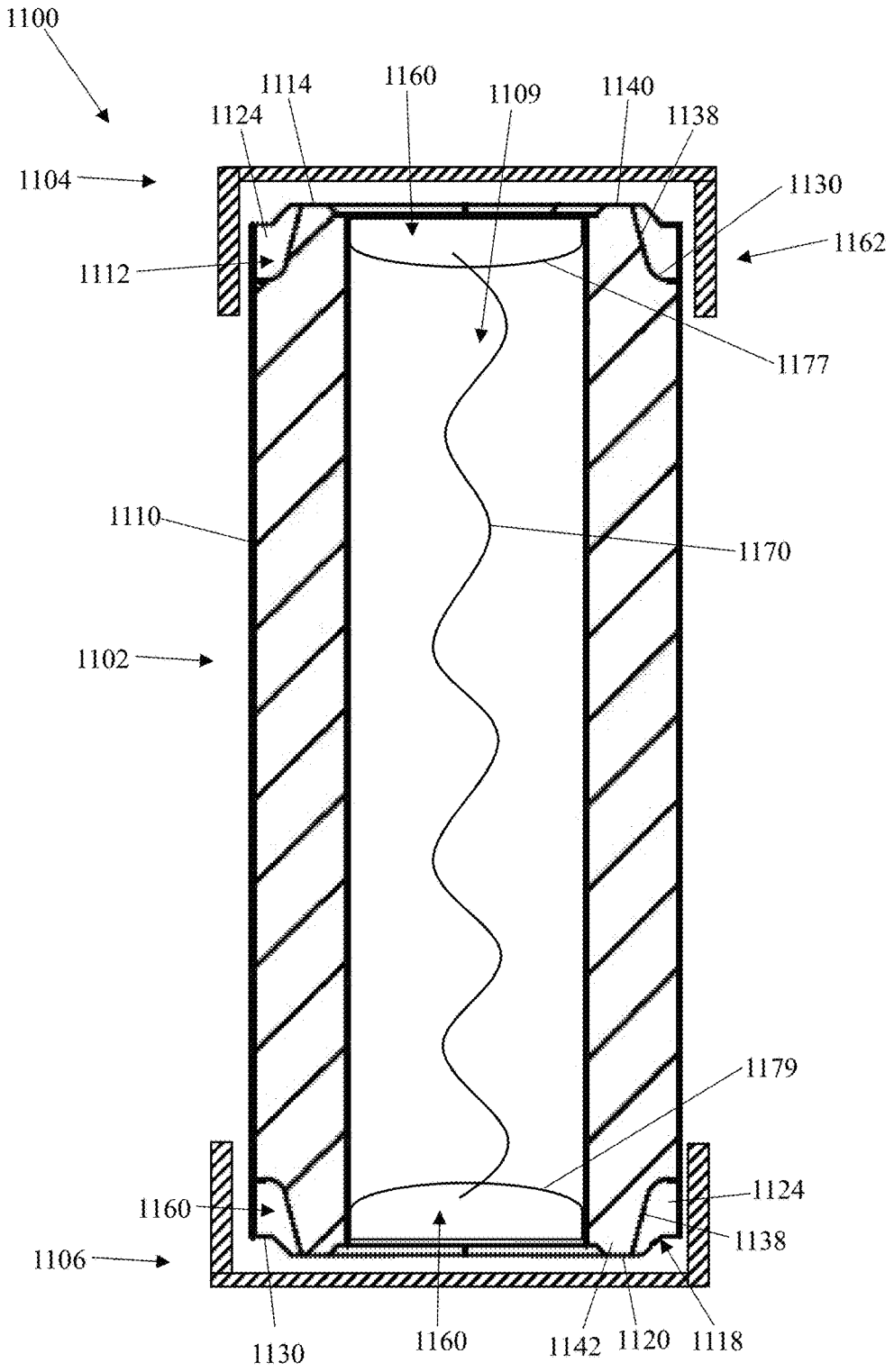

FIGS. 9-10B illustrate other exemplary embodiments of a hollow body 1100. The hollow body 1100 may be implemented as part of a protection device, such as a fuse. The hollow body 1100 may include a central portion 1102 disposed between a first end portion 1104 and a second end portion 1106. As shown, the central portion 1102 may have an outer square cross-sectional profile. However, embodiment of the present disclosure are not limited to any particular shape or cross-sectional profile. For example, in some embodiments, the hollow body 1100 may have a generally circular profile in cross-section, e.g., as viewed from the first or second end portions 1104, 1106. The central portion 1102 includes a central cavity 1109 extending between the first end portion 1104 and the second end portion 1106, and a plurality of exterior surfaces 1110 defining the outer cross-sectional profile of a first size. In a non-limiting embodiment, the hollow body 1100 includes four (4) generally flat exterior surfaces. The hollow body 1100 may be ceramic, plastic, or other suitable electrically non-conducting material. A first endcap 1162 may fit over the first end portion 1104 of the hollow body 1100, and a second endcap 1164 may fit over the second end 1106 of the hollow body 1100.

As shown, the first end portion 1104 may include one or more trenches 1112 formed/recessed into an upper (e.g., a first end) surface 1114 thereof, and extending partially between the exterior surfaces 1110 and the central cavity 1109. Similarly, the second end portion 1106 may include one or more trenches 1118 formed/recessed into a lower (e.g., a second end) surface 1120 thereof, and partially between the exterior surfaces 1110 and the central cavity 1109. Trenches 1112 and 1118 may each include a set of sidewalls 1124, a base surface 1130, and an inner wall 1138. In some embodiments, the set of sidewalls 1124 and/or the inner wall 1138 may be sloped or curved. For example, as shown, the set of sidewalls 1124 of the first end portion 1104 may extend away from the upper surface 1114, towards the second end portion 1106, wherein the set of sidewalls 1124 slope towards one another towards the base surface 1130. Said another way, a distance between the set of sidewalls 1124 directly adjacent the upper surface 1114 may be greater than a distance between the set of sidewalls near the base surface 1130. The sloped surface of the set of sidewalls 1124 may facilitate flow of the solder 1160 into the trenches 1112. Furthermore, in some embodiments, a lip or ledge 1175 of the base surface 1130 may be provided to better retain the solder 1160 within the trenches 1112.

Between each of the trenches 1112 and 1118 are respective corner sections 1140 and 1142, which are generally planar with the upper surface 1114 and the lower surface 1120, respectively. In some embodiments, one or more of the corner sections 1140, 1142 may include a recessed ledge 1150 to permit solder flow and wrapping of a fusible element 1170. Although not limited to any particular shape or profile, the corner sections 1140, 1142 and the trenches 1112 and 1118 may cause the hollow body 1100 to take on a castle-trench form.

As shown, solder 1160 may be disposed within the central cavity 1109 and each of the first and second endcaps 1162, 1164. More specifically, the solder 1160 may be disposed along a periphery of the hollow body 1100, for example, along the upper surface 1114 and the lower surface 1120, as well as partially along the one or more of the plurality of exterior surfaces 1110. As shown in FIG. 10A, the fusible element 1170 may be disposed within the central cavity 1109 of the hollow body 1100, and extend between an interior of the first endcap 1162 and an interior of the second endcap 1164. The fusible element 1170 may extend along also extend along the upper surface 1114 and the lower surface 1120 of respective first and second end portions 1104 and 1106, as well as partially along the one or more of the plurality of exterior surfaces 1110. As shown in FIG. 10B, the fusible element may be a corrugated or "drop-in" wire extending between a first solder dome 1177 and a second solder dome 1179 within the central cavity 1109. In this embodiment, the trenches 1112 and 1118 are an entry point for air pressure from a cooling chamber (not shown) to obtain better solder dome formation. More specifically, the design of the present fuse body allows pressure to penetrate along the upper surface 1114 and the lower surface 1120, as well as partially along the one or more of the plurality of exterior surfaces 1110. This allows better formation of the first and second solder domes 1177, 1179 as compared to conventional slotted bodies having slots on two sides only.

The trenches 1112 and 1118 may be entirely or partially filled with solder 1160 when the first endcap 1162 and/or the second endcap 1164 is pressed onto respective first and second end portions 1104 and 1106 of the hollow body 1100. In some embodiments, heat may be applied to the first and second endcap 1162, 1164 to enable the solder 1160 to flow. Thus, one or more of the trenches 1112 and 1118 serve as a pocket for the solder 1160, thus aiding in the retention of the first and second endcaps 1162, 1164, as well as the fusible element 1170. More particularly, in some embodiments, the hardened solder 1160 in the trenches 1112 and 1118 may couple or be integral with hardened solder within the central cavity 1109 and the endcaps 1162, 1164. As a result, the hardened solder 1160 in the trenches 1112 and 1118 serves as an anchor for the first and second endcaps 1162, 1164 pressed thereupon, which in turn apply pressure to the fusible element 1170 wrapped around the first and second end portions 1104 and 1106.

Although not shown, the hollow body 1100 may include a layer of metallization, similarly to the layer of metallization 908 shown in FIG. 7, on one or more of the first and second end portions 1104 and 1106. The solder 1160 may come in contact with the layer of metallization when the first or second endcaps 1162, 1164 are pressed onto each end portion 1104, 1106. Thus, since the layer of metallization is in contact with the solder 1160 and with portions of a fusible element 1170, the layer of metallization may facilitate robust electrical conductivity between the solder 1160, the fusible element 1170, and the first and second endcaps 1162, 1164 pressed onto one or more of the first and second end portions 1104 and 1106.

While hollow body fuses and a method for manufacturing structurally hollow body fuses have been described with reference to certain embodiments, it will be understood by those skilled in the art that various changes may be made and equivalents may be substituted without departing from the spirit and scope of the claims of the application. Other modifications may be made to adapt a particular situation or material to the teachings disclosed above without departing from the scope of the claims. Therefore, the claims should not be construed as being limited to any one of the particular embodiments disclosed, but to any embodiments that fall within the scope of the claims.

We claim:

1. A fuse comprising:

a hollow body including a center portion extending between a first end portion and a second end portion, wherein the first end portion includes a plurality of first trenches disposed in a first end surface, wherein the second end portion includes a second plurality of trenches disposed in a second end surface, and wherein the first end surface includes a first plurality of corner sections each having a recessed ledge extending between a pair of first trenches of the plurality of first trenches;

a first endcap surrounding the first end portion and a second endcap surrounding the second end portion;

a fusible element disposed within a central cavity of the hollow body, the fusible element extending between the first end surface and the second end surface; and solder disposed within the first trench and the second trench, the solder in contact with at least one of: the fusible element, the first endcap, and the second endcap.

2. The fuse according to claim 1, the first plurality of trenches and the second plurality of trenches each comprising:

a set of sidewalls;

an interior wall extending between the set of sidewalls; and a base surface extending from the interior wall.

3. The fuse according to claim 1, wherein the solder is further disposed between the first end surface and the first endcap, and between the second end surface and the second endcap.

4. The fuse according to claim 1, the hollow fuse body including an exterior surface, wherein the fusible element extends partially along the exterior surface.

5. The fuse according to claim 4, wherein the exterior surface comprises a plurality of sides, and wherein the second end surface includes a second plurality of corner sections each having a recessed ledge extending between a pair of second trenches of the plurality of second trenches.

6. The fuse according to claim 4, wherein the first trench and the second trench extend from the exterior surface towards the central cavity.

7. The fuse according to claim 1, wherein the fusible element extends along a substantially diagonal path through a center of the central cavity.

8. The fuse according to claim 1, wherein the fusible element wraps partially around the first end surface and the second end surface.

9. The fuse according to claim 1, wherein the fusible element is in physical contact with an interior surface of the first endcap and an interior surface of the second endcap.

10. A protection device, comprising:

a hollow body including a center portion extending between a first end portion and a second end portion, wherein the first end portion includes a plurality of first trenches formed in a first end surface, wherein the second end portion includes a plurality of second trenches formed in a second end surface, and wherein the first end surface includes a first plurality of corner sections each having a recessed ledge extending between a pair of first trenches of the plurality of first trenches;

a first endcap surrounding the first end portion and a second endcap surrounding the second end portion;

a fusible element disposed within a central cavity of the hollow body, the fusible element extending between the first end surface and the second end surface; and solder disposed within one or more of the first plurality of trenches and one or more of the second plurality of trenches, the solder in contact with the first endcap and the second endcap.

11. The protection device according to claim 10, the first plurality of trenches and the second plurality of trenches each comprising:

a set of sloped sidewalls;

an interior wall extending between the set of sidewalls; and a base surface extending from the interior wall.

12. The protection device according to claim 10, wherein the solder is further disposed between the first end surface and the first endcap, and between the second end surface and the second endcap, and wherein the solder is in contact with the fusible element.

13. The protection device according to claim 10, the hollow fuse body including an exterior surface, wherein the fusible element extends partially along the exterior surface.

14. The protection device according to claim 13, wherein the first plurality of trenches and the second plurality of trenches extend inward from the exterior surface towards the central cavity.

15. The protection device according to claim 10, wherein the fusible element partially wraps around the first end surface and the second end surface.

16. A protection device, comprising:

a fuse body including a center portion extending between a first end portion and a second end portion, wherein the first end portion includes a plurality of first trenches recessed into a first end surface, wherein the second end portion includes a plurality of second trenches recessed into a second end surface, and wherein the first end surface includes a first plurality of corner sections each having a recessed ledge extending between a pair of first trenches of the plurality of first trenches;

a first endcap surrounding the first end portion and a second endcap surrounding the second end portion;

a fusible element disposed within a central cavity of the fuse body, the fusible element extending between and wrapping around the first end surface and the second end surface; and solder disposed within one or more of the first plurality of trenches and one or more of the second plurality of trenches, the solder in contact with the first endcap, the second endcap, and the fusible element.

17. The protection device according to claim 16, wherein the first plurality of trenches each comprise:

a set of sidewalls extending away from the first end surface of the first end portion and towards the second end portion, the set of sidewalls sloping towards one another;

an interior wall extending between the set of sidewalls; and a base surface extending from the interior wall, the base surface including a lip for retaining the solder.

18. The protection device according to claim 16, wherein the solder is further disposed between the first end surface and the first endcap, and between the second end surface and the second endcap, and wherein the solder is in contact with the fusible element.

19. The protection device according to claim 16, the hollow fuse body including an exterior surface, wherein the fusible element extends along the first end surface, the second end surface, and partially along the exterior surface.

* * * * *